US005651866A

United States Patent [19]

Gradowski

[11] Patent Number: 5,651,866

[45] Date of Patent: Jul. 29, 1997

[54] FOLDABLE PANEL ARRANGEMENT FOR PLATING BARREL

[75] Inventor: Stephen Gradowski, Sharon, Conn.

[73] Assignee: Whyco Chromium Company, Inc., Thomaston, Conn.

[21] Appl. No.: 663,355

[22] Filed: Jun. 13, 1996

[51] Int. Cl.[6] ..... C25D 17/20

[52] U.S. Cl. ..... 204/213; 204/279

[58] Field of Search ..... 204/213, 214, 204/279

[56] References Cited

U.S. PATENT DOCUMENTS

| | | | |
|---|---|---|---|
| 2,836,400 | 5/1958 | Jackson | 204/213 X |
| 3,936,985 | 2/1976 | Marulli | 204/213 X |
| 4,018,427 | 4/1977 | Marulli | 204/213 X |
| 4,401,542 | 8/1983 | Zamiska et al. | 204/213 |

*Primary Examiner*—Donald R. Valentine
*Attorney, Agent, or Firm*—DeLio & Peterson, LLC

[57] ABSTRACT

A barrel for chemically treating parts having a panel system for retaining said parts within said barrel while permitting passage of a bath solution into said barrel. The panel system comprises a plurality of side panels formed from a continuous sheet of material with integral hinges connecting said panels. The hinges comprises a notch having a center, and first and second sides with thickness greater than said center and a material fused to and filling in the notch. The side panels comprise a base and a plurality of perforated sections on the base, with each perforated section containing a plurality of openings in the base for passage of the solution. A plurality of ribs extends outwardly from one surface of the base, wherein the ribs separate each of the perforated sections from an adjacent perforated section. The ribs are comprised of individual rib segments, with each rib segment separating one perforated section from an adjacent perforated section. Each of the rib segments intersect at a point with at least one other rib segment between adjacent perforated sections. At each of the intersection points, at least one rib segment terminates with other rib segments, the terminating rib segment being non-colinearly oriented with respect to other intersecting ribs to provide bracing for another intersecting rib segment. Preferably, three of the rib segments intersect at the intersection point between adjacent perforated panel sections. The perforated panel sections may be rectilinear, circular or hexagonal in shape.

15 Claims, 8 Drawing Sheets

Fig. 12
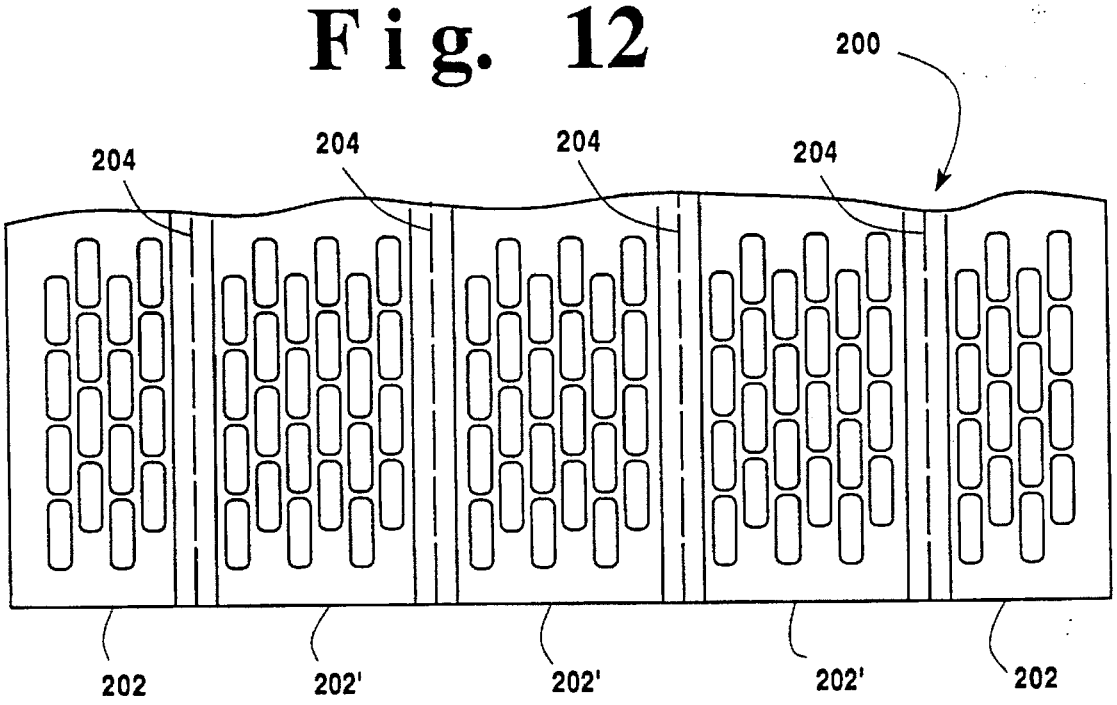
Fig. 13
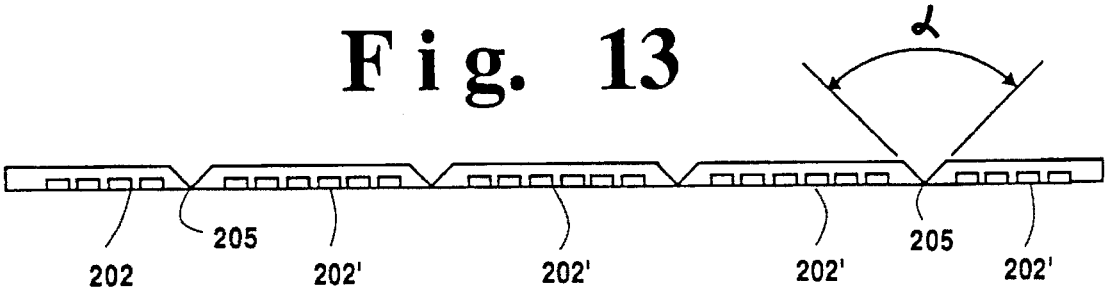
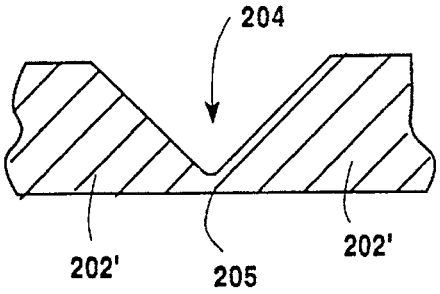
Fig. 14

FOLDABLE PANEL ARRANGEMENT FOR PLATING BARREL

BACKGROUND OF THE INVENTION

1. Field of the Invention

The present invention relates to barrels for holding parts during electroplating and, in particular, to barrel construction utilizing folding hinge panels and fusion welded joints.

2. Description of Related Art

Barrels with a polygonal axial cross-section have long been used in electroplating small components. Such barrels typically have six sides comprised of perforated rectangular panels, at least one of which may be removed to provide access to the interior of the drum for filling and removing parts. The drums are rotated along an axis while being at least partially immersed in a bath or solution for electroplating or otherwise chemically treating parts. As they are tumbled and plated within the solution, the individual metal parts within the barrel are retained within the barrel (due to the perforation size being less than the part size) and are simultaneously exposed to the electroplating solution which enters through the perforations in the panels.

Such barrels are normally removable from the plating tank in which they operate for loading and unloading the parts. It is not unusual for such barrels to be used for temporary part storage prior to or subsequent to the plating treatment in the bath. The barrels may be moved around the plating facility, for example, by forklift truck, and may be stacked on shelving or on top of one another. As a consequence, the barrels are subject to rough handling and the panels making up the barrel often impact against other hard objects. Since it is generally necessary to utilize non-electrically conductive materials for the panels, e.g., plastics or other non-metallic materials, and the brittleness which occurs with age and exposure to plating solutions, the panels are often weak and may easily sustain damage.

Because of the need to maintain a relatively smooth surface on the interior of the barrel while providing adequate strength for the perforations and the panels themselves, some prior art plating barrels have utilized panels having ribs extending outward from the barrel, which ribs enclose one or more perforations in the panel. An example of such a plating barrel panel is shown in U.S. Pat. No. 3,936,985 which discloses a panel having a rib structure in the form of a rectangular grid. Likewise, U.S. Pat. No. 4,018,427 discloses a rectangular grid structure for the ribs which includes a second set of cross ribs which are shallower than the primary set of cross ribs. U.S. Pat. No. 3,953,633 also discloses panels having a grid-like arrangement of ribs. U.S. Pat. Nos. 4,422,774 and 4,162,951 disclose other plating barrel styles utilizing grid-like ribs on the side panels.

While such rectangular grid structures partially fulfill a long felt need for improved panel structures, they do not provide sufficient resistance to rough handling typically encountered in plating facilities. As a result, alternative panels for barrels have used thick panel sides for increased resistance to damage.

Another problem encountered with prior art plating barrels is bath solution "drag out" i.e., the retention of bath solution in the perforations due to a capillary effect. Thick wall plating barrels show good resistance to damage, but they increase the amount of bath solution retained in the barrel which is dragged out and transferred from one bath to the other or otherwise lost from the system itself. Such dragged out solution has to be replenished, creating additional plating expense, and, because of the nature of some plating baths, contributes to toxic waste which must be handled and neutralized. Thin wall plating barrel panels used prior to the present invention provide some improvement in this area, but have not be able to withstand the damage done in a factory environment.

These prior art plating barrels have traditionally been constructed using a number of separate side panels mounted to fixed panel support members. For instance, separate panels have been joined together by inserting them into slotted rib pieces and fusion welding the joints. The rib pieces are costly because they must be individually machined and the process of joining them to the individual side panels requires numerous welds totaling many linear feet.

Bearing in mind the problems and deficiencies of the prior art, it is therefore an object of the present invention to provide an improved plating barrel configuration which has improved durability in a manufacturing environment.

It is another object of the present invention to provide a plating barrel panel with ribs which provides better resistance to impact and decreases the amount of damage to the ribs themselves.

It is a further object of the invention to provide a plating barrel side panel that has sufficient perforations for bath solution to enter the barrel, but has a lower hole volume in order to reduce the potential for drag out of plating bath chemicals.

It is yet another object of the present invention to provide a high impact resistance plating barrel panel which has thin wall configuration around the panel perforations.

It is a further object of the invention to provide a plating barrel configured from a continuous sheet of material which does not require separate connectors.

It is a further object of the invention to provide a plating barrel with integrally hinged panels.

It is a further object of the invention to provide a plating barrel which requires a reduced amount of welding for assembly.

Still other objects and advantages of the invention will in part be obvious and will in part be apparent from the specification.

SUMMARY OF THE INVENTION

The above and other objects and advantages, which will be apparent to those skilled in the art, are achieved in the present invention which is directed to a barrel for chemically treating parts having a perforated side panel for retaining the parts within the barrel while permitting passage of a bath solution into the barrel. The plating barrel is constructed by machining all the side panels out of one continuous sheet of material, with an integral V-shaped notch between each side panel. Enough material is left at the bottom of each notch to form a flexible hinge. The sheet is then folded at each hinge to form the shape of the barrel, and the notches are filled by fusion welding. This new process eliminates the need for machined rib pieces and reduces both the number and linear feet of welds required to assemble the barrel.

In one embodiment, the panel comprises a base and a plurality of perforated sections on the base, with each perforated section containing a plurality of openings in the base for passage of the solution. A plurality of ribs extends outwardly from one surface of the base, wherein the ribs separate each of the perforated sections from an adjacent perforated section. The ribs are comprised of individual rib segments, with each rib segment separating one perforated section from an adjacent perforated section. Each of the rib segments intersect at a point with at least one other rib segment between adjacent perforated sections. At each of the intersection points, at least one rib segment terminates with other rib segments, the terminating rib segment being non-colinearly oriented with respect to other intersecting ribs to provide bracing for another intersecting rib segment. Preferably, three of the rib segments intersect at the intersection point between adjacent perforated panel sections.

In another embodiment, two of the intersecting rib segments are colinearly oriented and a third rib segment is non-colinearly oriented with respect to the first two rib segments. The perforated panel sections may be rectilinear in shape such that no more than three of the rib segments intersect at an intersection point between adjacent perforated panel sections. Preferably, three of the rib segments intersect at the point, with two of the intersecting rib segments being colinearly oriented and the third rib segment being non-colinearly oriented with respect to the first two rib segments.

In yet another embodiment, none of the intersecting rib segments are colinearly oriented with respect to the other two rib segments. The perforated panel sections may be circular or hexagonal in shape, or a mixture of alternating square and octagonal shapes, such that no more than three of the rib segments intersect at an intersection point between adjacent perforated panel sections.

The barrel panel preferably comprises a chemically inert material. The side of the base opposite the ribs may be substantially smooth or may be uneven.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 12 is a top plan view of the present invention illustrating the continuous sheet panel arrangement unfolded in a horizontal position.

FIG. 13 is a side elevational view illustrating a 90-degree V-shaped notch in between each of the side panels.

FIG. 14 is a greatly enlarged view of the V-shaped notch area circled in FIG. 13.

DESCRIPTION OF THE PREFERRED EMBODIMENTS

In describing the preferred embodiments of the present invention, reference will be made herein to FIGS. 1–16 of the drawings in which like numerals refer to like features of the invention.

Figure 1:
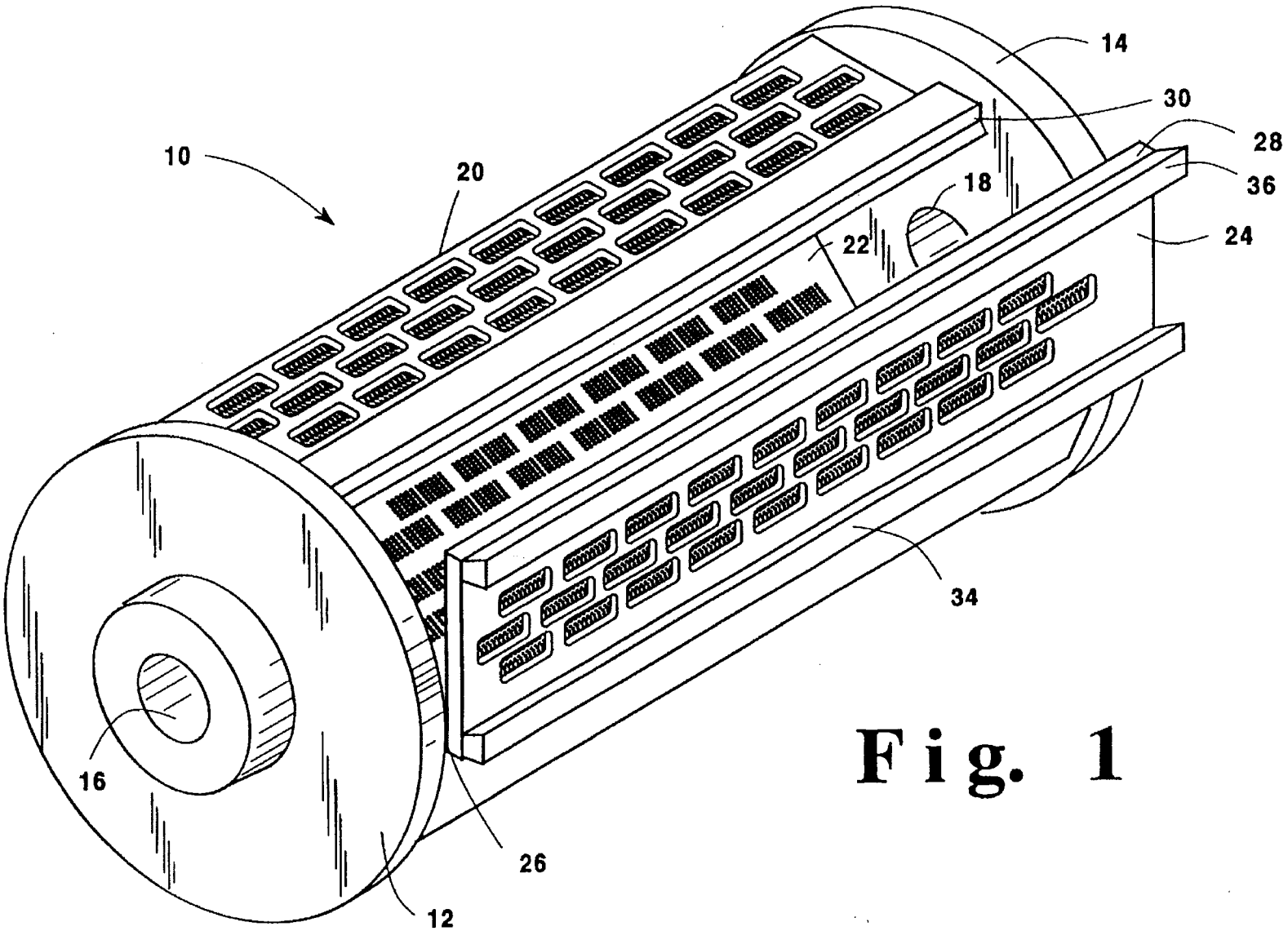
FIG. 1 is a perspective view of a plating barrel incorporating the panels of the present invention utilizing a rectangular rib structure.

A plating barrel 10 constructed in accordance with the present invention is shown in FIG. 1. Barrel 10 includes circular end caps or plates 12, 14, having axially located center openings or holes 16, 18, respectively, for mounting onto the suspension and drive mechanism in the plating tank. Extending longitudinally between the end plates are a plurality of perforated panels configured in accordance with the present invention. Such panels include a fixed panel 20 as well as a removable access panel 24, each employing the staggered rib structure surrounding a plurality of openings or perforations, which will be explained in more detail below. Access panel 24, which may be removed for loading or unloading parts in to the barrel, has mating edges 26, 28 on its longitudinal sides. Access panel edge 28 mates with access frame member 30 which is secured at each end to caps 12 and 14. Access door 24 also includes support members 34, 36 which run along the longitudinal edges. As shown, the interior surface 22 of the panels is smooth (except for the openings or perforations in the panel), i.e., there are no strengthening ribs extending inward into the plating barrel as the panels are mounted thereon.

Figure 2:
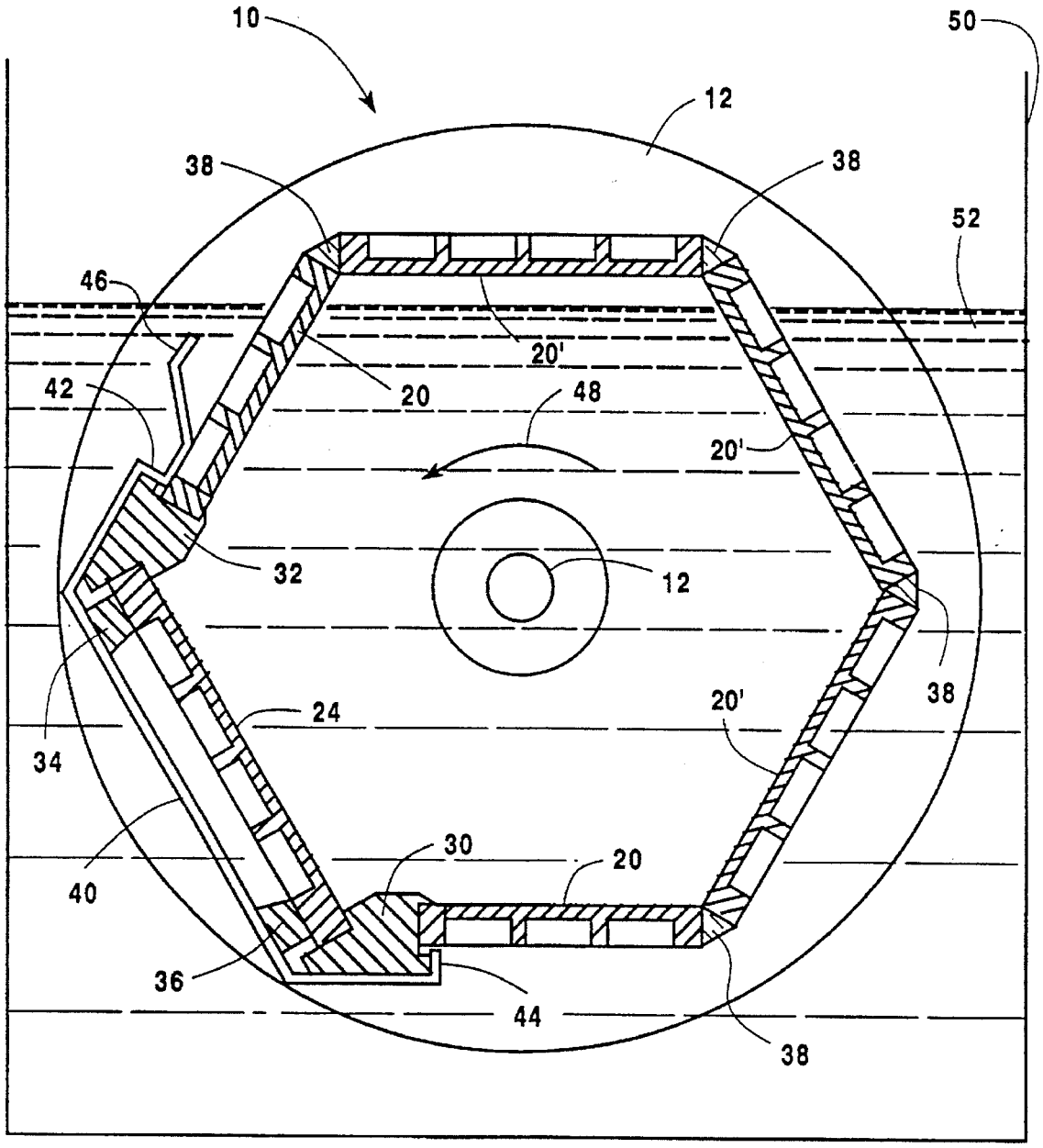
FIG. 2 is a cross-sectional end view of the plating barrel of FIG. 1 immersed in a plating bath within a plating tank.

Turning to FIG. 2, plating barrel 10 is shown mounted within plating tank 50 and almost full immersed in plating bath solution 52. As used herein, the term "bath" or "solution" refers to any electroplating bath or other chemical treatment solutions which are well known in the art. Examples of plating solutions which may be used with the present invention include the following bath formulations and operating conditions:

| Sulfate-Chloride Bath: | |
|---|---|
| Nickel sulfate | 26 oz/gal (195 g/L) |
| Nickel chloride | 23 oz/gal (174 g/L) |
| Boric acid | 5.3 oz/gal (40 g/L) |
| pH | 1.5 |
| Temperature | 115° F. (46° C.) |
| Current density | 26–100 amp/ft$^2$ |
| **All-Sulfate Bath:** | |
| Nickel sulfate | 40 oz/gal (300 g/L) |
| Boric acid | 5.3 oz/gal (40 g/L) |

-continued

| | |
|---|---|
| Temperature | 115° F. (46° C.) |
| pH | 3.0–5.0 |
| Current density | 25–100 amp/ft$^2$ |

For barrel plating, the following compositions may also be employed:

| | Potassium | Sodium |
|---|---|---|
| Copper cyanide | 45.0–60.0 g/L (6.0–8.0 oz/gal) | 45.0–60.0 g/L (6.008.0 oz/gal) |
| Total potassium cyanide | 80.3–109.5 g/L (10.7–14.0 oz/gal) | |
| Total sodium cyanide | — | 64.5–88.5 g/l (8.6–11.8 oz/gal) |
| Potassium carbonate | 15.0 g/L (2.0 oz/gal) | — |
| Sodium carbonate | — | 15.0 g/L (2.0 oz/gal) |
| Potassium hydroxide | 7.5–22. g/L (1.0–3.0 oz/gal) | — |
| Sodium hydroxide | — | 7.5–22.5 g/L (1.0–3.0 oz/gal) |
| Rochelle salt | 45 g/L (6.0 oz/gal) | 45 g/L (6.0 oz/gal) |
| Free potassium cyanide by analysis | 15.0–22.5 g/L (2.0–3/0 oz/gal) | — |
| Free sodium cyanide by analysis | — | 15.0–22.5 g/L (2.0–3.0 oz/gal) |
| Temperature | 60–71° C. (140°–160° F.) | |

Barrel 10 is mounted to the drive mechanism (not shown) for rotation in the direction shown by arrow 48. Panels 20, 20' may be welded or maybe mounted to fixed panel support members 38 by any well known means utilized in the prior art for such construction. Access frame panel members 30, 32 receive access panel 24 and complete the support members for the plating barrel. During the normal operation within the plating bath, access panel 24 is secured in place on the barrel by a spring closure 40 which has opposite closure ends 42,44 which wrap around and grip support members 32 and 30, respectively. A handle end 46 extending from spring closure end 42 is provided to remove the spring and remove the access panel.

Figure 3:
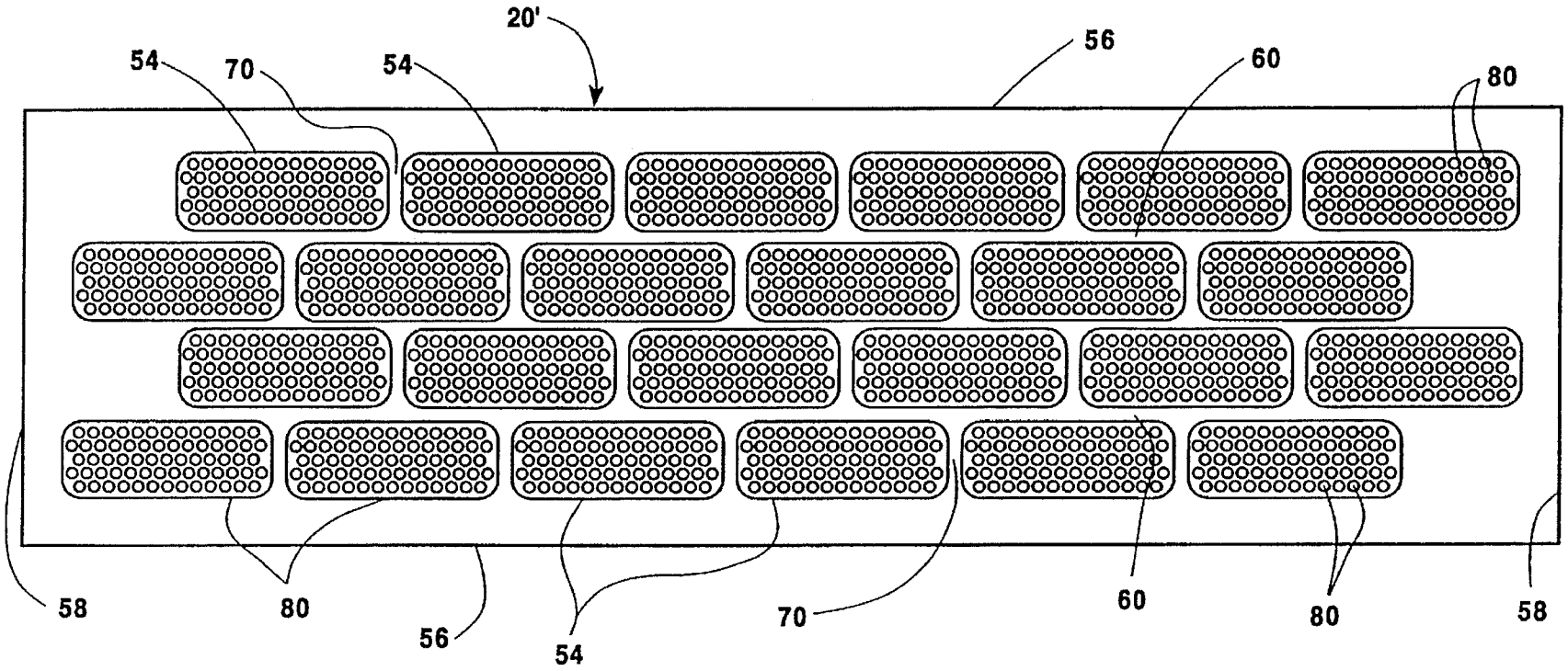
FIG. 3 is a top plan view of one of the panels of the present invention utilizing a rectangular rib structure.
Figure 4:
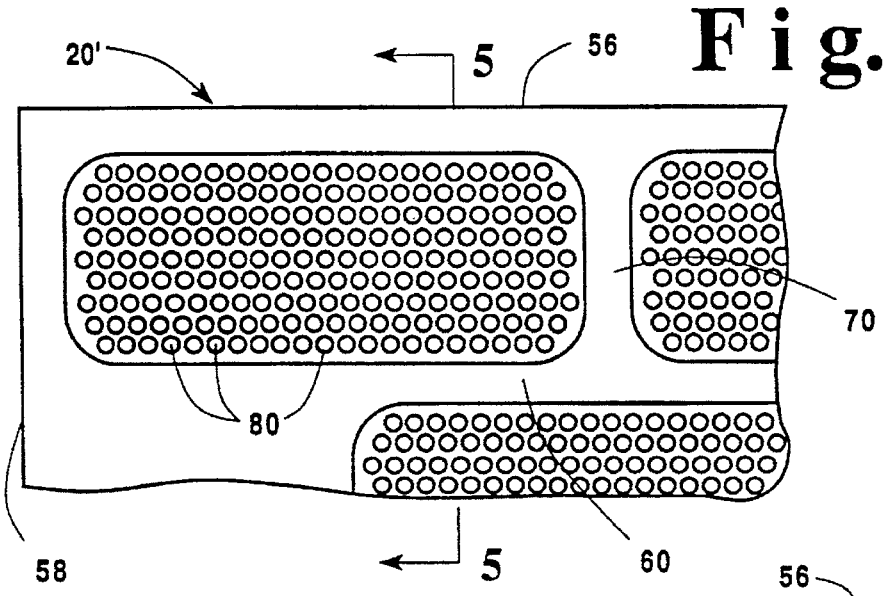
FIG. 4 is an enlargement of a portion of the panel of FIG. 3.
Figure 5:
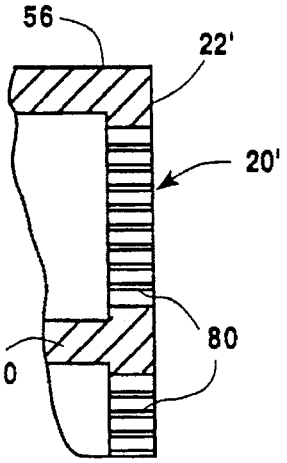
FIG. 5 is an elevational view of a section of the panel portion shown in FIG. 4.
Figure 7:
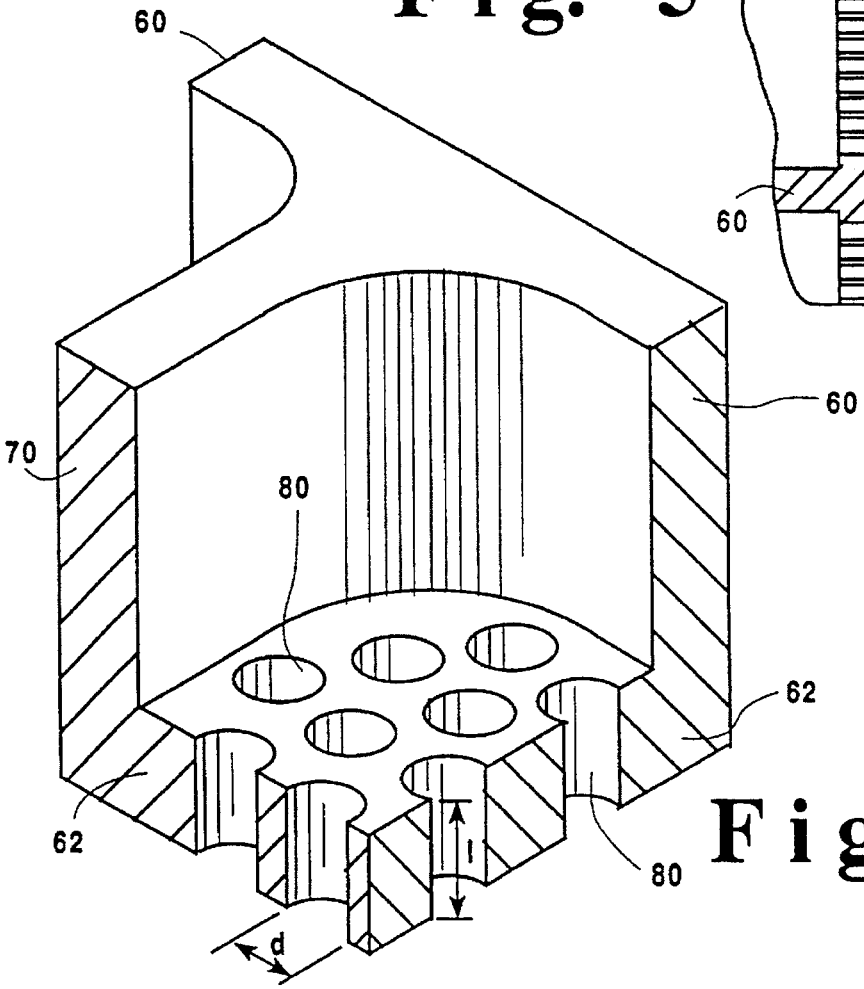
FIG. 7 is a cross-sectional perspective view of a portion of the panel of FIG. 3.
Figure 6:
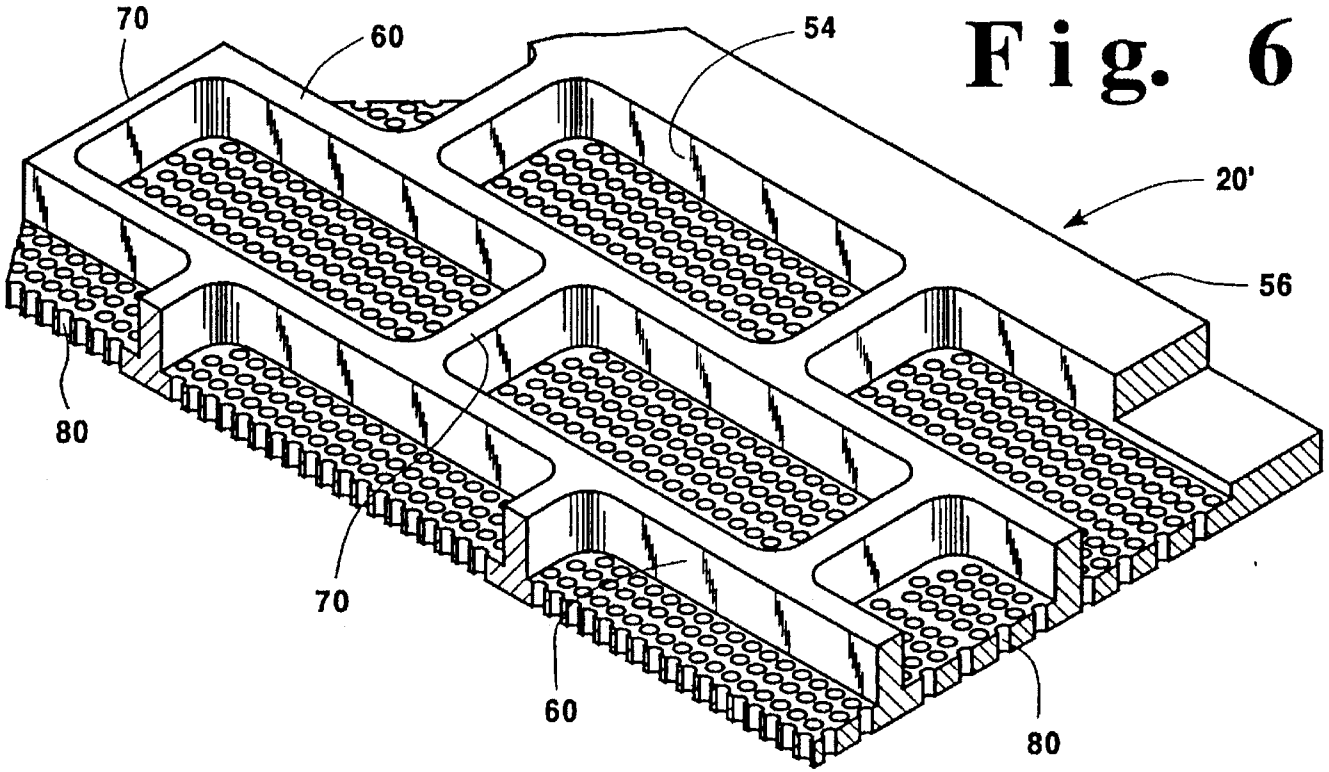
FIG. 6 is a perspective view of a portion of the panel of FIG. 3.

The preferred embodiment of the plating barrel panel of the present invention is shown in FIG. 3. Panel 20' has longitudinal edges 56 and ends 58, and is preferably made of a tough, impact-resistant polymer, for example, stress relieved polypropylene. Within panel 20' are plurality of rectangular sections 54 bounded by strengthening ribs, each of which sections 54 contain a plurality of small openings or perforations 80 which permit the plating bath or solution to enter the plating barrel during processing without allowing the parts to fall out. Although openings 80 are shown as having circular configurations, any known or desired configuration may be utilized for these openings. In accordance with the present invention, the rectangular sections 54 are bounded by longitudinal strengthening ribs 60 and cross member strengthening ribs 70.

As also shown in FIGS. 4–7, longitudinal ribs 60 intersect with cross ribs 70 in an intermediate portion of each rectangular section, preferably at a mid-point. Within the field of the rectangular sections (i.e., away from panel edges) the cross ribs 70 do not continue beyond the longitudinal ribs 60 with which they intersect, but instead terminate to provide bracing for and strengthening of the longitudinal ribs. This construction is in contrast to the structure of the prior art in which the cross ribs extend beyond the longitudinal ribs with which they intersect. The net effect of the panel rib configuration of the present invention is to strengthen the longitudinal ribs at the points at which they are the weakest, i.e., mid-way between the ends of the individual sections of perforations which the ribs surround and form. This unique construction permits the base of the panel containing openings 80 to be relatively thin while retaining the advantages of high toughness and durability as the ribs are impacted in the course of movement around the plating facility. Since polymers such as polypropylene typically get brittle with time and as a result of contact with plating solutions, the improved strength is even more important as the barrels age.

As shown, the aspect ratio of each of the rectangular sections, i.e., the ratio of length to width, is greater than one (1). However, an aspect ratio of one (a perfect square) can also be used provided the cross-ribs are staggered as described above.

An important aspect of the present invention is the thin panel base 62 (FIG. 7) through which openings 80 are formed. The length "l" and diameter "d" of these openings determines the amount of solution which may be retained or trapped within the openings by capillary effect. The volume of each opening is calculated as $l \times \pi \times (d/2)^2$. In accordance with a preferred embodiment of present invention, each of the openings may have a diameter in the range of 5/64 to 15/64 in. (2.0–6.0 mm) and a length (base thickness) of approximately 3/16 to 3/8 in. (4.8–9.5 mm). Total panel thickness (rib plus base thickness) may preferably range from 3/8 to 1 in. (9.5–25.4 mm). For example, a panel may have a of length 42 in. (107 cm), width 8 in. (20.3 cm), rectangular section width 15/16 in. (23.8 mm), rectangular section length 2 5/16 in. (58.7 mm), section rib height 9/16 in. (14.3 mm), rib thickness 3/16 in. (4.8 mm), opening diameter 5/64 in. (2.0 mm), base thickness 3/16 in. (4.8 mm) and 27% panel area perforation. Panels made in accordance with the present invention may provide a 10–30 percent increase in plating efficiency and a 30–60 percent reduction in plating solution drag out.

Panels configured in accordance with the present invention may be manufactured by any known means, for example, machining from sections of polypropylene having thickness equal to the total thickness of the panel (base thickness plus rib height). Alternatively, these panels may be manufactured by injection molding, or manufactured by a combination of the aforementioned processes. Preferably, each panel is of integral construction, i.e., made from a single piece of section of starting material, although multipiece construction may also be utilized. The panel configuration of the present invention may also be utilized in a variety of styles and sizes of plating barrels.

Figure 8:
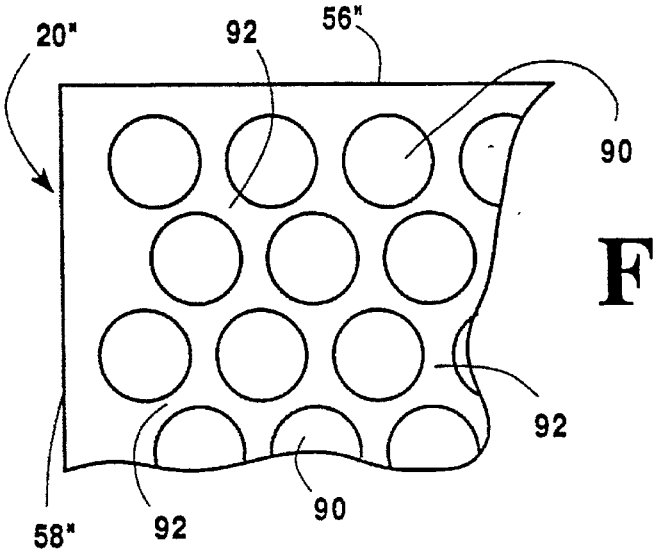
FIG. 8 is a top plan view of a portion of an alternate panel embodiment of the present invention utilizing a circular rib structure.
Figure 9:
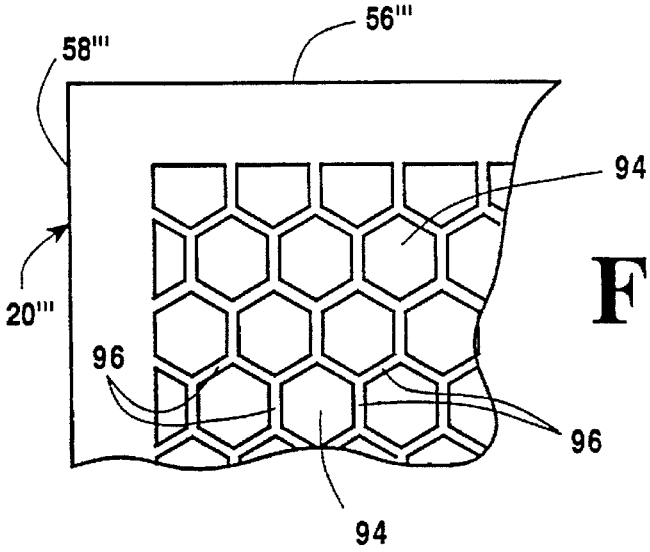
FIG. 9 is a top plan view of a portion of an another alternate panel embodiment of the present invention utilizing hexagonal rib structure.
Figure 10:
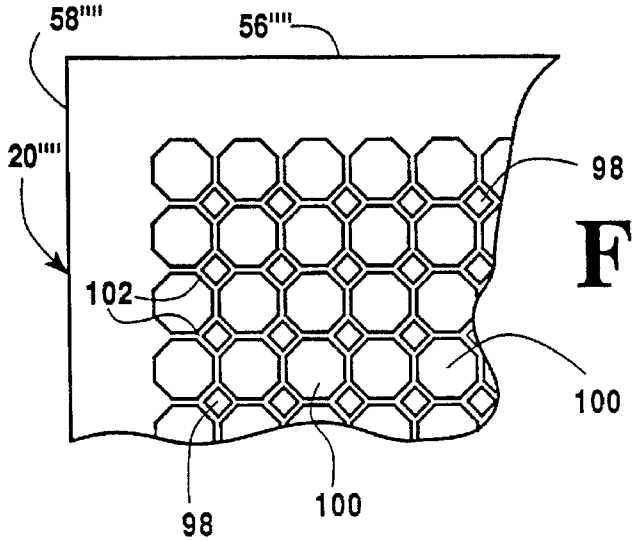
FIG. 10 is a top plan view of a portion of an another alternate panel embodiment of the present invention utilizing a mixed square and octagonal rib structure.

Alternate embodiments of the rib configuration of the present invention are shown in FIGS. 8, 9 and 10. In FIG. 8 there is shown a portion of panel 20" having a plurality of circular sections 90 formed by ribs 92. The circular sections 90 are arranged in what is normally considered to be a "close packed" configuration. Within each circular section there is a base containing openings (not shown) corresponding to base 62 and openings 80 described previously. Within the fields of the circular sections away from panel edges 56", 58", ribs 92 intersect such that no one of the ribs extends straight beyond the point of intersection with the other two (2) ribs.

FIG. 9 shows panel 20'" portion having a plurality of hexagonal sections 94 formed by ribs 96. The hexagonal sections 96 are also arranged in what is normally considered to be a "close packed" configuration. Again, within each hexagonal section 94 there is a base containing openings (not shown) corresponding to base 62 and openings 80 described previously. As with the fields of the circular sections, away from panel edges 56''', 58''' ribs 96 intersect each of the other two (2) ribs such that no one of the ribs extends straight beyond the point of intersection.

A mixture of alternating square 98 and octagonal 100 panel sections is shown for panel section 20''' in FIG. 10. Rib segments 102 form the boundaries of the square and octagonal sections which contain openings (not shown) corresponding to base 62 and openings 80 described previously. As with the fields of the circular and hexagonal sections, away from panel edges 56'''', 58'''' ribs 102 intersect each of the other two (2) ribs such that no one of the ribs extends beyond the point of intersection in a straight line.

Alternatively, a mixture of one or more of the rectangular, square, hexagonal, octagonal or circular perforated panel section configurations may be used in a single panel. Other section configurations bounded by ribs may be employed, provided that at least one of the ribs does not extend in a straight line beyond the point of intersection with other section-forming ribs.

Figure 11:
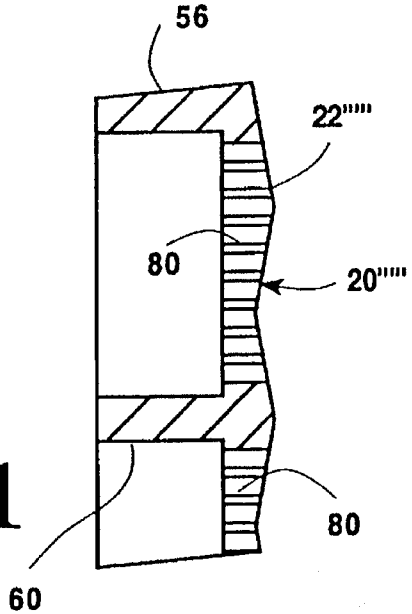
FIG. 11 is an elevational view of a section of an alternate embodiment of the panel portion shown in FIG. 4.

While a panel constructed in accordance with the present invention may have a substantially smooth inner surface (FIG. 5), the panel may also be constructed with a dimpled, scored, striated or otherwise uneven surface to prevent parts from sticking to the panels during treatment. Such sticking tends to occur when the parts being plated or otherwise treated have flat surfaces. An embodiment of such inner surface is depicted in FIG. 11 in which panel 20'''' is shown having an uneven surface 22''''.

Figure 15:
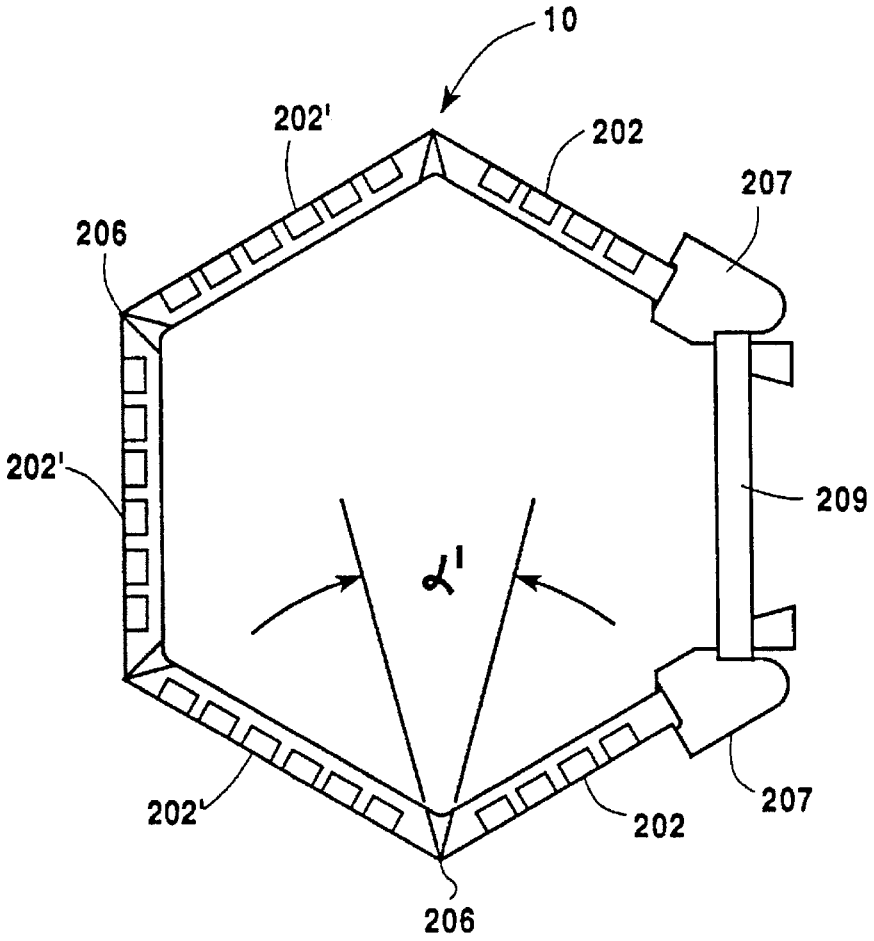
FIG. 15 is a top plan view of the present invention in the folded configuration and illustrating a 30 degree fusion welded angle between panels in the folded configuration.

The plating barrel of FIG. 15 is formed from a continuous sheet of material 200, with plastic being preferred. The sheet 200 consists of a plurality of side panels 202, 202' connected by a flexible hinge formed from an integral notch 204 between adjacent side panels as illustrated in FIGS. 12–13, with a V-shaped notch being preferred. The number side panels of the plating barrel formed from the continuous sheet may vary, with five being preferred. The plating barrel used for part plating described above may have the panel perforations as described above, other panel perforations or any combination of panels with and without perforations.

Figure 16:
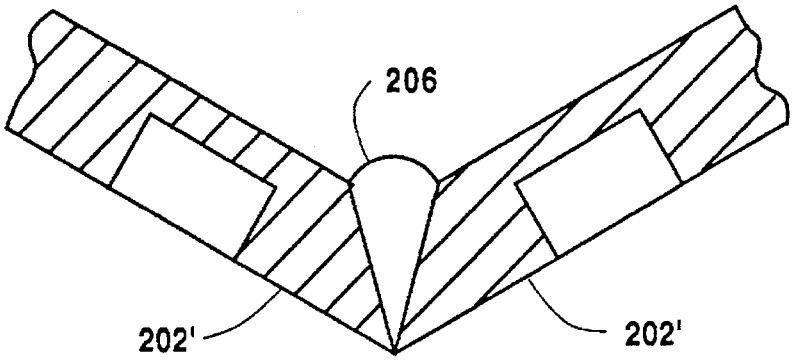
FIG. 16 is a greatly enlarged view of the area circled in FIG. 15 illustrating a fusion welded joint.

In the unfolded configuration of FIGS. 12–13, the connecting hinges are formed with a notch having an angle $\alpha$ between adjacent panels. The angle $\alpha$ is preferably 90 degrees, but could vary depending upon the thickness of the panels and the width of the notch opening. Sufficient material is left at the bottom of each notch 204 to form a flexible hinge 205. The sheet is folded at each hinge 205 into a barrel shape illustrated in FIG. 15 with the resulting notches having angle $\alpha'$ in between the adjacent side panels. The angle $\alpha'$ the of assembled barrel is preferably 30 degrees, however, $\alpha'$ may vary as the number of side panels, the dimensions of the side panels and the notch widths vary. The notch 204 is reinforced or filled by a similar or compatible material, such as extruded polypropylene, with a fusion welder such as the MEG 342 Extrusion Welder manufactured by Wegner North America, Inc. of Burr Ridge, Ill. The welded hinge 206 is illustrated in FIG. 16.

The plating barrel of FIG. 15 is assembled as follows: a continuous sheet of material shown in FIGS. 12 and 13 is folded to the configuration of FIG. 15; closure ends 207 are placed on each side panel end 208; a closure panel 209 is connected in between the closure ends 207 and each notch 204 is fusion welded. Thus, the present invention provides improved strength in connection with the rib configuration disclosed herein, which enables plating barrels incorporating panels made with such rib configurations to more readily withstand impact damage in plant environments. Additionally, increased strength permits a thinner base to be employed, and, consequently, the lower volume achieved in the holes forming the panel perforations significantly reduces waste an potential pollution due to plating solution drag out. The new construction also eliminates the need for machined rib pieces and reduces both the number and linear feet of welds required to assemble the barrel.

While the present invention has been particularly described, in conjunction with specific preferred embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A barrel for chemically treating parts having a perforated side panel for retaining said parts within said barrel while permitting passage of a bath solution into said barrel, said side panels comprising:

a base;

a plurality of perforated sections on said base, each perforated section containing a plurality of openings in said base for passage of said solution;

a plurality of ribs extending outwardly from one surface of said base, said ribs separating each of said perforated sections from an adjacent perforated section;

said ribs comprised of individual rib segments, each rib segment separating one perforated section from an adjacent perforated section, each of said rib segments intersecting at a point with at least one other rib segment between adjacent perforated sections;

at each of said intersection points, at least one rib segment terminating with other rib segments, the terminating rib segment being non-colinearly oriented with respect to other intersecting ribs to provide bracing for another intersecting rib segment;

each of said panels being formed from a continuous sheet of material with integral hinges connecting said panels.

2. The barrel of claim 1 wherein three of said rib segments intersect at said point, and wherein two of the intersecting rib segments are colinearly oriented and the third rib segment is non-colinearly oriented with respect to said first two rib segments.

3. The barrel of claim 1 wherein said perforated sections are hexagonal in shape and wherein no more than three of said rib segments intersect at said point.

4. The barrel of claim 3 wherein three of said rib segments intersect at said point, and wherein none of the intersecting rib segments are colinearly oriented with respect to the other two rib segments.

5. The barrel of claim 1 wherein said panel comprises a chemically inert material.

6. A barrel for chemically treating parts having a perforated side panel for retaining said parts within said barrel while permitting passage of a bath solution into said barrel, said side panels comprising:

a base;

a plurality of perforated sections on said base, each perforated section containing a plurality of openings in said base for passage of said solution wherein said perforated sections are rectilinear in shape and wherein no more than three of said rib segments intersect at said point;

a plurality of ribs extending outwardly from one surface of said base, said ribs separating each of said perforated sections from an adjacent perforated section;

said ribs comprised of individual rib segments, each rib segment separating one perforated section from an adjacent perforated section, each of said rib segments intersecting at a point with at least one other rib segment between adjacent perforated sections;

at each of said intersection points, at least one rib segment terminating with other rib segments, the terminating rib segment being non-colinearly oriented with respect to other intersecting ribs to provide bracing for another intersecting rib segment; and each of said panels being formed from a continuous sheet of material with integral hinges connecting said panels.

7. The barrel of claim 6 wherein three of said rib segments intersect at said point, and wherein two of the intersecting rib segments are colinearly oriented and the third rib segment is non-colinearly oriented with respect to said first two rib segments.

8. The barrel of claim 7 wherein said perforated sections are circular in shape and wherein no more than three of said rib segments intersect at said point.

9. The barrel of claim 8 wherein three of said rib segments intersect at said point, and wherein none of the intersecting rib segments are colinearly oriented with respect to the other two rib segments.

10. A barrel panel system for retaining parts within a chemical treatment barrel, said panel system comprising a plurality of panels made from a chemically inert material and having:

a base;

a plurality of ribs extending outwardly from one surface of said base, said ribs defining a plurality of rectilinear shaped perforated sections on said base, each section containing a plurality of openings in said base for passage of said solution, said ribs forming boundaries around said perforated rectilinear sections;

said ribs being comprised of individual rib segments, each rib segment separating one perforated rectilinear section from an adjacent perforated rectilinear section, each of said rib segments intersecting at a point with two other rib segments between adjacent perforated rectilinear sections;

at each of said intersection points, two of the intersecting rib segments being colinearly oriented and the third rib segment being non-colinearly oriented with respect to said first two rib segments to provide bracing for the other intersecting rib sections;

each of said panels being formed from a continuous sheet of said chemically inert material with integral hinges connecting said panels.

11. The barrel of claim 10 wherein the side of said base opposite said ribs is substantially smooth.

12. The barrel of claim 10 wherein the side of said base opposite said ribs is uneven.

13. A barrel panel system for retaining parts within a chemical treatment barrel, said panel system comprising a plurality of panels made from a chemically inert material and having:

a base;

a plurality of ribs extending outwardly from one surface of said base, said ribs defining a plurality of round perforated sections on said base, each section containing a plurality of openings in said base for passage of said solution, said ribs forming boundaries around said perforated round sections;

said ribs being comprised of individual rib segments, each rib segment separating one perforated round section from an adjacent perforated round section, each of said rib segments intersecting at a point with two other rib segments between adjacent perforated round sections;

at each of said intersection points, two of the intersecting rib segments being colinearly oriented and the third rib segment being non-colinearly oriented with respect to said first two rib segments to provide bracing for the other intersecting rib sections;

each of said panels being formed from a continuous sheet of said chemically inert material with integral hinges connecting said panels.

14. The barrel of claim 13 wherein the side of said base opposite said ribs is substantially smooth.

15. The barrel of claim 13 wherein the side of said base opposite said ribs is uneven.

* * * * *